US005662222A

United States Patent [19]

Thayer et al.

[11] Patent Number: 5,662,222

[45] Date of Patent: Sep. 2, 1997

[54] INFORMATIONAL MEDIA MAILER WITH REPLY CARD

[76] Inventors: Bryan Keith Thayer, 1121 E. Eagle Ridge Cir., Sandy, Utah 84094; Kerri Denise Scarbrough, 672 E. 640 North, Orem, Utah 84057

[21] Appl. No.: 599,550

[22] Filed: Dec. 18, 1995

[51] Int. Cl.[6] ..... B65D 85/672

[52] U.S. Cl. ..... 206/387.1; 229/92.8

[58] Field of Search ..... 206/387.1, 387.11, 206/784, 232; 229/92, 92.8, 87.01

[56] References Cited

U.S. PATENT DOCUMENTS

| | | | |
|---|---|---|---|
| 4,127,229 | 11/1978 | Roccaforte | 229/44 CB |
| 4,688,677 | 8/1987 | Roccaforte | 206/624 |
| 4,846,348 | 7/1989 | Smith | 206/387 |
| 5,078,268 | 1/1992 | Olson et al. | 206/387.1 |
| 5,199,662 | 4/1993 | Klupt | 242/199 |
| 5,272,583 | 12/1993 | Yerkes | 360/132 |
| 5,272,752 | 12/1993 | Williamson | 242/199 |
| 5,293,994 | 3/1994 | Antik | 206/387 |
| 5,353,931 | 10/1994 | Antaik | 206/387.1 |

*Primary Examiner*—Jacob K. Ackun
*Attorney, Agent, or Firm*—Mark G. Sandbaken

[57] ABSTRACT

Packaging designed for mailing informational media to a recipient, the packaging including a return response with an attached reply card. The packaging protects the informational media from damage during mailing. The informational media may include audio or video tape or a CD. The reply card is detachable from the package. The packaging is preferably secured by an attached closure without the use of other closure mechanisms.

12 Claims, 6 Drawing Sheets

INFORMATIONAL MEDIA MAILER WITH REPLY CARD

I. BACKGROUND OF THE INVENTION

A. Field of the Invention

This invention relates to the field of packaging for mailing informational media. More specifically, this invention relates to packaging for informational media which includes a reply mail card that is attached to the packaging and may be returned to the mailer by the person receiving the informational media.

B. Description of Related Art

Many cartons and boxes have been produced to contain informational media such as audio tapes, video tapes and compact disks ("CD's"). Such boxes are usually constructed of plastic or paper stock and are designed to protect the media from damage during storage or transport. Such boxes or cartons may include cardboard or plastic boxes for holding video or audio tapes and "jewel cases for holding CD's. Such boxes or cartons are not, however, constructed for mailing purposes and typically do not comply with postal regulations. Larger boxes have been designed for mailing informational media; these boxes, however, are primarily constructed of plastic and require additional packaging, support or closure devices when mailing or shipping.

U.S. Pat. No. 4,846,348 discloses a two-way mailing envelope for written and oral messages. Similarly, U.S. Pat. No. 5,293,994 discloses mailable packaging for video cassettes. Printed information may be included on such a package. U.S. Pat. No. 5,199,662 discloses a video cassette mailer having a detachable mailing flap which may include advertisements or coupons.

These types of packaging are useful for mailing informational media, but do not provide ready means for the person receiving such information to communicate with the sender. In particular, it is desirable for a package containing informational media to include a readily detachable reply card which can be returned by the person receiving the package. Such a reply card can be included to request additional information from the person receiving the informational media. The informational media may include, but is not limited to, operating instructions for a product recently purchased by a consumer, advertising media, survey or educational informational, or any other type of information which a sender may wish to convey, and for which the sender desires to receive a reply.

Packaging has also been designed to hold a sample lipstick along with an order form. This packaging is mailable, but requires a separate sticker for closure, and no reply card is attached. Similarly, other packaging may include a video cassette package with a flap folding over itself to form a container for mailing. However, this box includes a perforation for easy opening which damages the box, and no reply card is included. Video cassette holders may also include a perforated flap that can be detached; however, it is not mailable without a securing device.

The present invention overcomes these defects by providing a compact, mailable enclosure for informational media which includes a reply card. In a preferred embodiment of the invention, the mailable enclosure may be self-sealing and not require an additional closure device.

II. SUMMARY OF THE INVENTION

The present invention provides a mailable package for informational media. The packaging has two additional flaps which fold over the main box. One flap is a reply card that is perforated and the other is an additional flap where additional information can be printed. The main box is formed from a single, integral planar paperboard blank which is folded. It may include a closure that securely closes the box. Such a This closure eliminates the need for additional closure devices or support. The attached reply card eliminates the need for separate insertions for a mailing which requests a reply.

It is an object of the present invention to provide mailable packaging which will protect the enclosed informational media. It is a feature of the invention that the mailable packaging may be used for all types of informational media including audio and video tapes and CD's. It is an advantage of the invention that the packaing may comply with the postal regulations in multiple countries.

It is an object of the invention to provide mailable packaging which includes a postal reply card. It is a feature of the invention the postal reply card is readily detachable from the packaging. It is an advantage of the invention that the postal reply card may form part of the packaging.

It is an object of the invention to provide mailable packaging which does not require additional fasteners or closure. It is a feature of the invention that the closure mechanism may be built into the blank for the packaging. It is an advantage of the invention that a built-in closure provides packaging which is readily sealed without additional materials.

These and other objects, features and advantages of the invention will be clear to a person of ordinary skill in the art upon reading this specification in light of the appending drawings.

III. BRIEF DESCRIPTION OF THE DRAWINGS

IV. DETAILED DESCRIPTION OF THE PREFERRED EMBODIMENT

Figure 1:
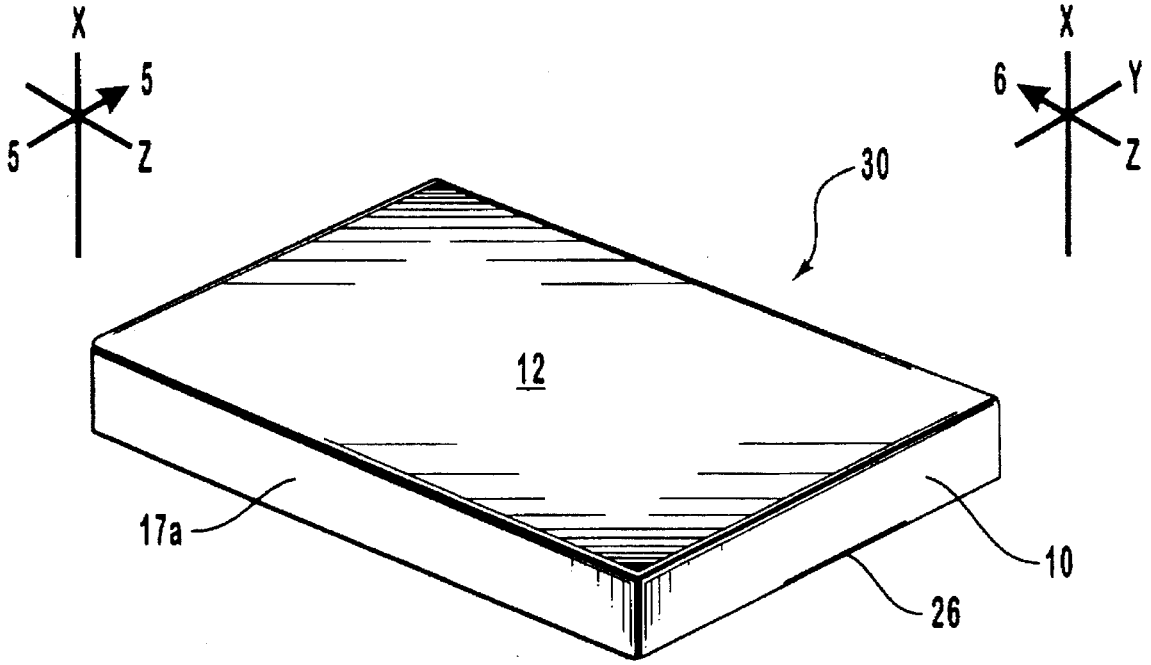
FIG. 1 is a perspective view of the top of the mailable packaging of the present invention.
Figure 2:
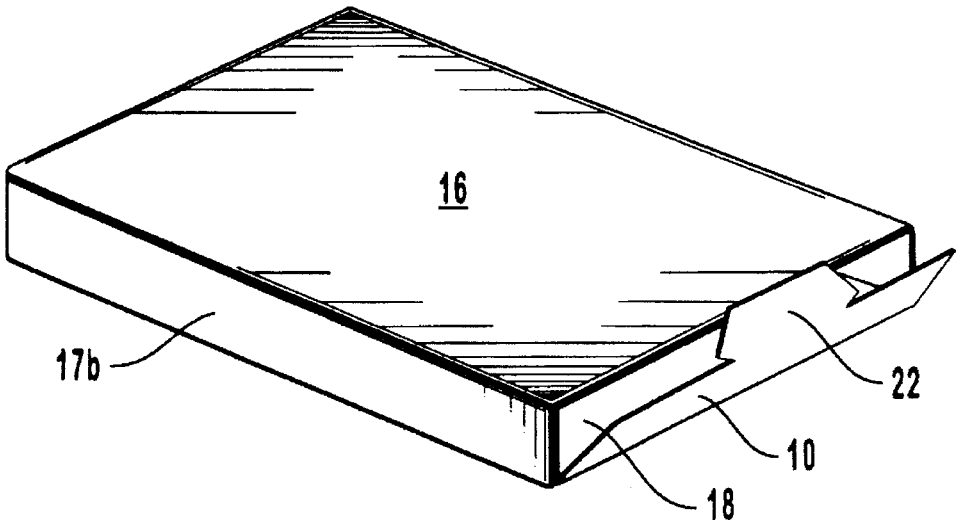
FIG. 2 is a perspective view of the bottom of the mailable packaging.
Figure 3:
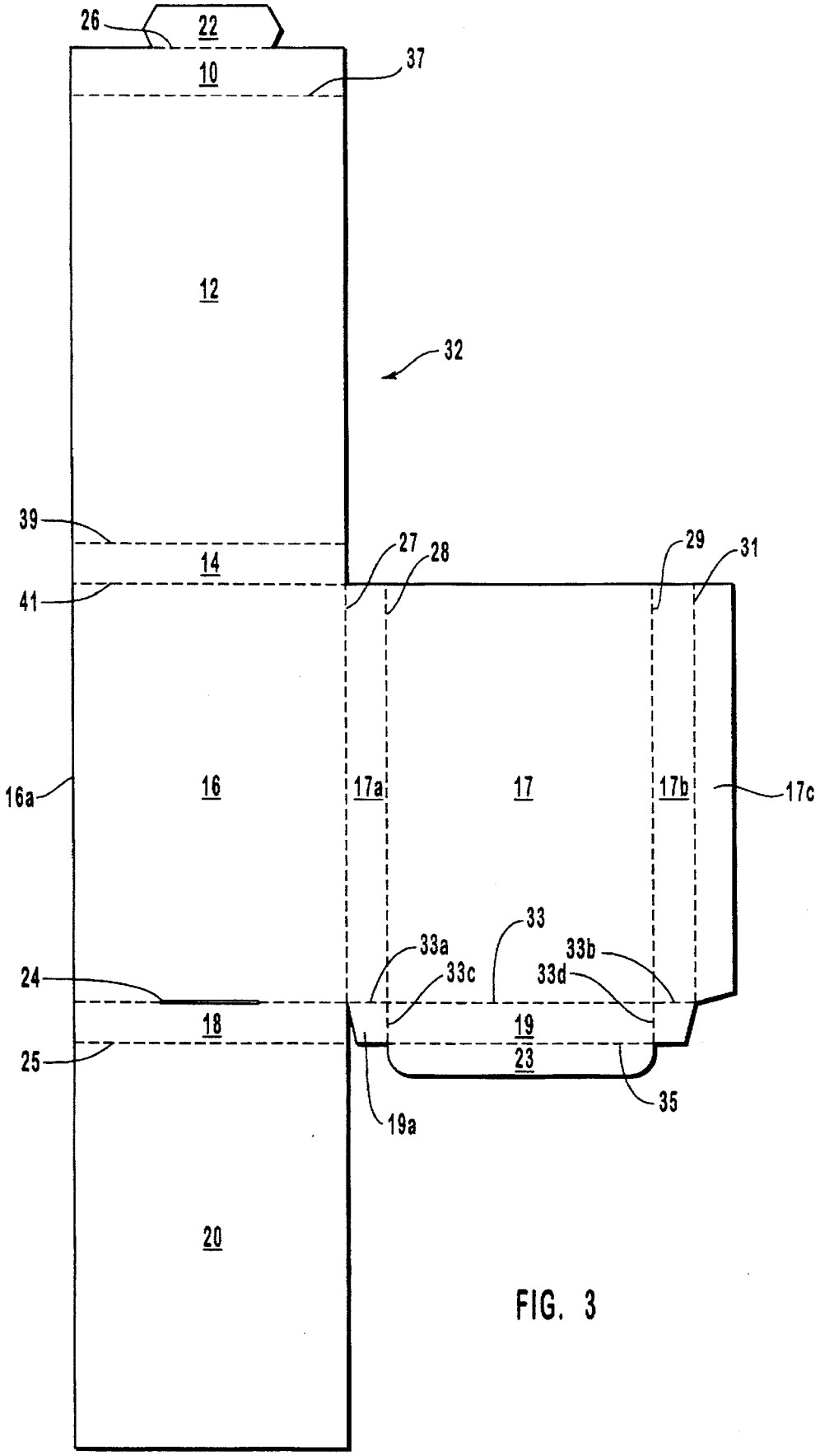
FIG. 3 is a plan view of the blank of FIG. 1.
Figure 4:
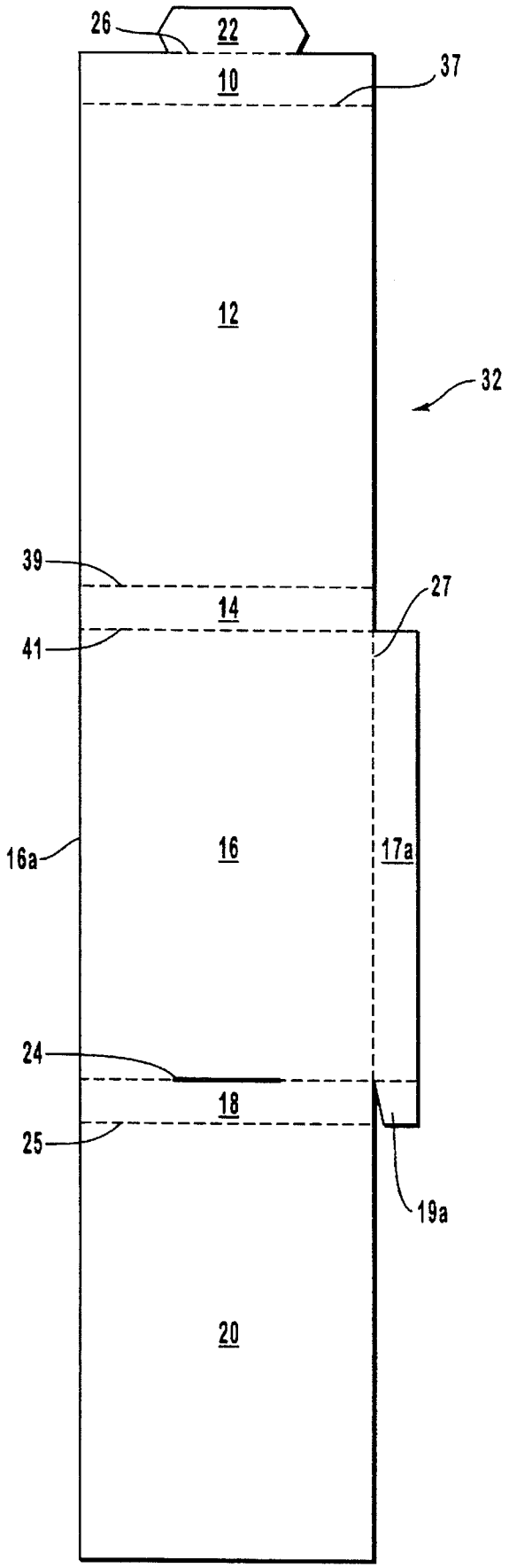
FIG. 4 is a plan view of the blank of FIG. 2 being folded to form the box for FIG. 1.
Figure 5:
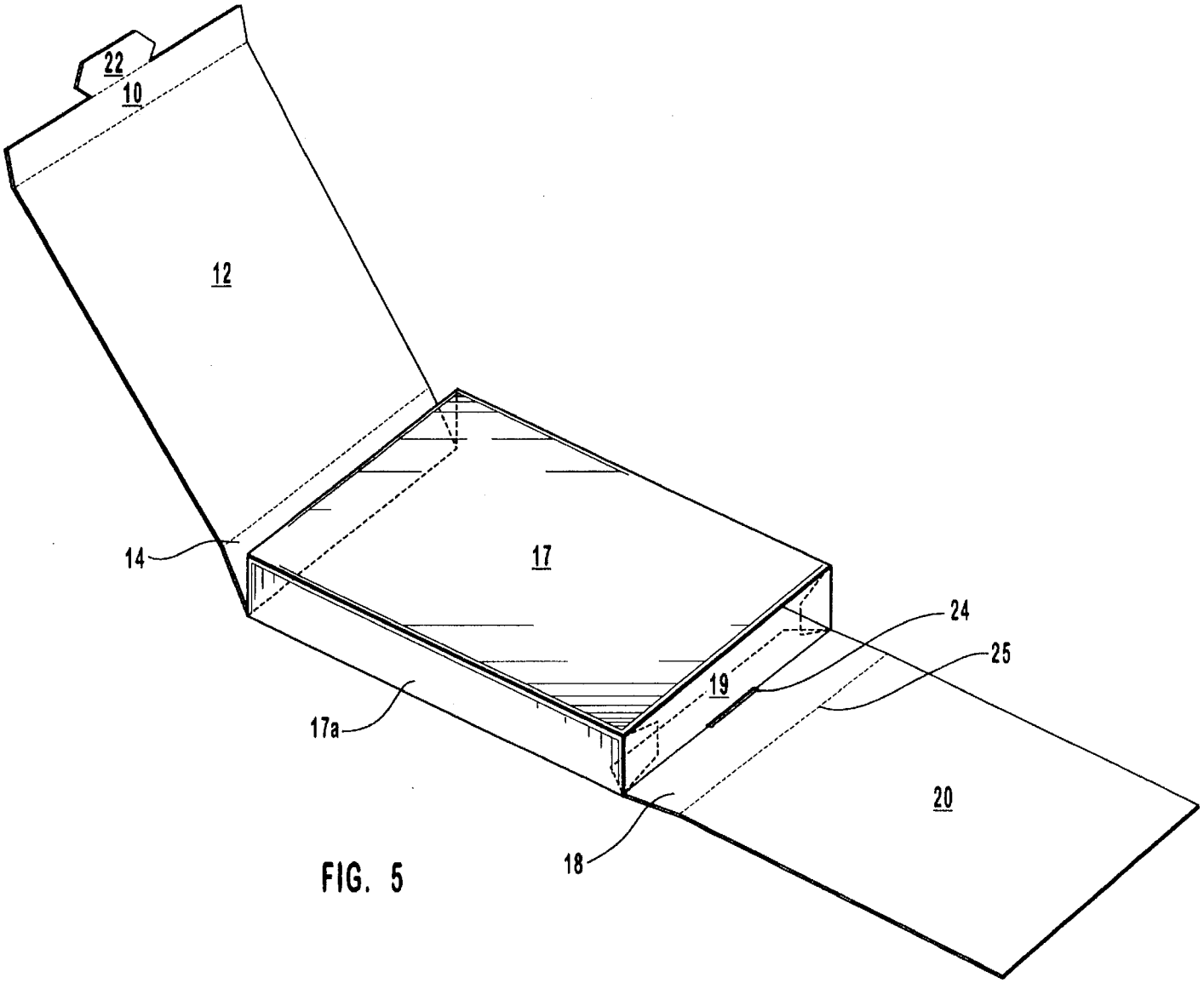
FIG. 5 is a perspective view of the box of FIG. 1 being opened.
Figure 6:
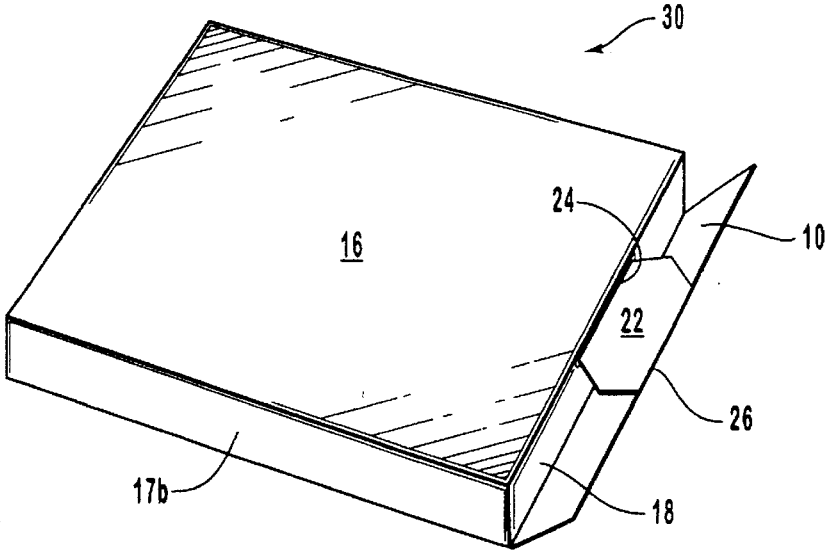
FIG. 6 is a perspective view of the box of FIG. 1 showing the closure insertion.

Referring now to the drawings in detail, wherein like numerals indicate like elements throughout the several views, the box 30 of the present invention is formed from a single, planar, unitary paperboard blank 32, as shown in FIG. 3.

Blank 32 includes three vertically aligned substantially rectangular panels 12, 16, and 20. One end of panel 12 is attached to smaller panel 10 by score line 37. In a preferred embodiment of the invention, panel 10 also connects to closure 22 along score line 26. Panels 12 and 16 are connected by smaller panel 14 along score lines 39 and 41, respectively. Panels 16 and 20 are connected smaller panel 18 along score lines 24 and 25, respectively. The center rectangular panel 16 includes a laterally extending panel 17 with extensions 17*a*, 17*b*, 17*c*. Panel 17*a* joins panels 16 and 17 along score lines 27 and 28, respectively. Panel 17*b* is connected to panel 17 along socre line 29. Panel 17*c* connects to panel 17*c* along score line 31. Panel 17 has an extension panel 19 connected to panel 17 along score line 33. Extensions 19*a* and 19*b* may be attached to panels 17*a* and 17*b*, respectively, along score line 33*a* and 33*b*, respectively. In this embodiment of the invention, score lines 33*c* and 33*d* are cut. Alternatively, extensions 19*a* and 19*b* may be attached to panel 19 along score lines 33*c* and 33*d*, respectively. In this embodiment of the invention, score lines 33*a* and 33*b* are cut.

Score line 25 may be perforated so that panel 20 is readily detachable from panel 18. Score line 24 may be partially cut to form a slit into which closure 22 may be inserted.

To assemble box 30 from blank 32, the blank is first folded along score lines 27, 28, 29 and 31. Panel 17*c* is folded over to edge 16*a* of panel 16 where an adhesive or other suitable fastening mechanism is applied to fasten panels 17*c* and 16 together along the outer edge 16*a* of 16. In the preferred embodiment of the invention, panel 17*c* is hidden after it is attached. The box is then folded at score lines 33 and 35. Panels 19*a* and 19*b* are folded in between panels 16 and 17. Panel 23 is then tucked adjacent to score line 24. Panel 20 is folded along the perforated line 25 and folded up and on top of panel 17. Score lines 26, 37, 39 and 41 are folded inward. Panel 14 is folded up, and then panel 12 is folded over superimposed panels 20 and 17. Panel 10 is folded over panel 18. In the preferred embodiment of the invention, closure 22 is then inserted into the slit along score line 24 where it is securely fastened. In a less preferred embodiment of the invention, panel 10 could be secured to panel 18 by adhesive, tape or other suitable fastening mechanism.

Figure 7:
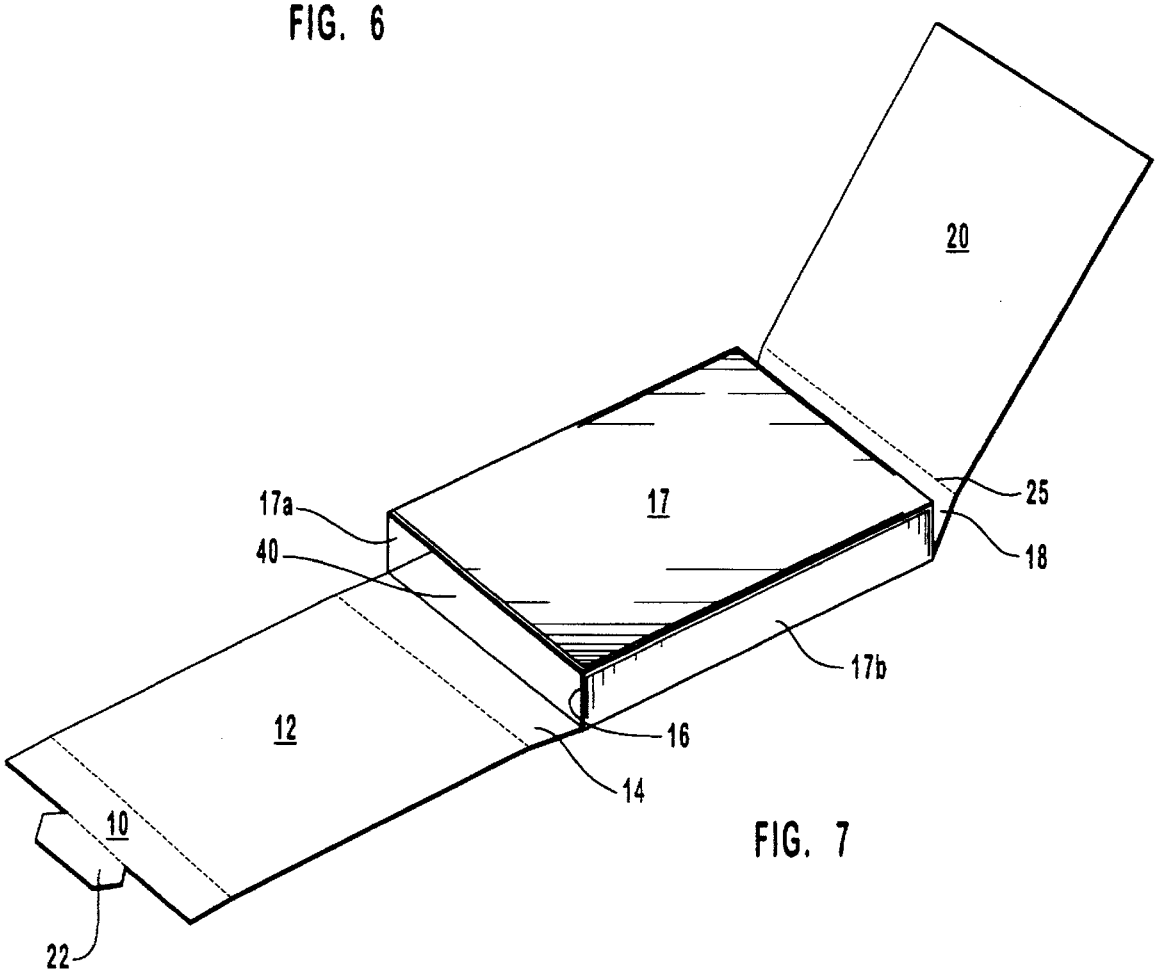
FIG. 7 is a different perspective view of the box of FIG. 1 being opened.
Figure 8:
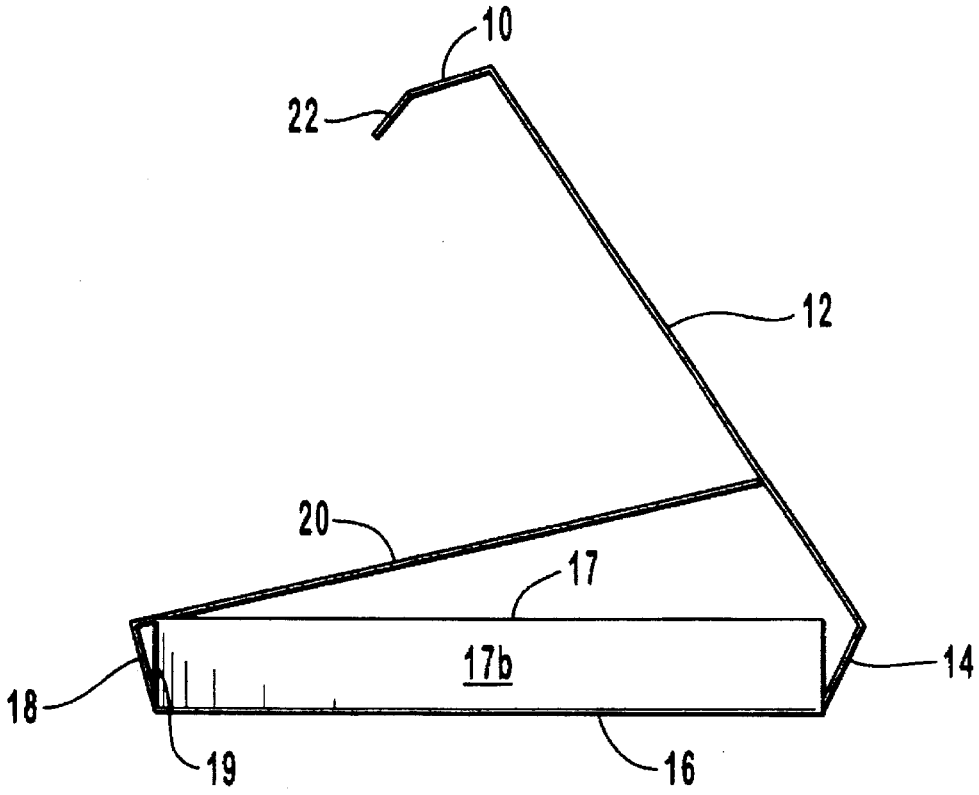
FIG. 8 is a cross-sectional view of the box of FIG. 1 partially open taken substantially along the plane indicated by line 5 of FIG. 1.
Figure 9:
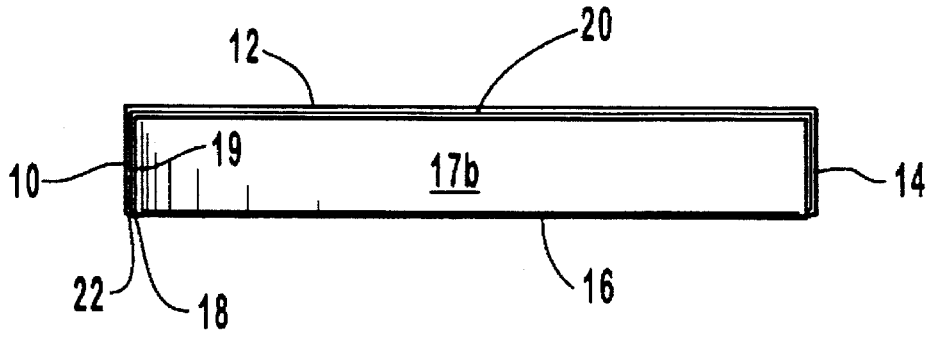
FIG. 9 is a cross-sectional view of the box of FIG. 1 taken substantially along the plane indicated by line 5 of FIG. 1.

In the assembled box, panel 12 forms the top front of box 30 and is disposed in a plane perpendicular to panel 10, which forms the lower front of the box 30. Panel 17*a* is disposed in a plane perpendicular to panel 12. Box 30 is then filled with informational media, such as an audio or video cassette or a CD, through the opening 40, as shown is FIG. 7. To mail box 30, it is only necessary to close the box, such as by inserting closure 22 into the slit in score line 24, or by using a suitable fastening mechanism to attach to panel 10 to panel 18.

In a preferred embodiment of the invention, panel 20 includes a detachable preprinted reply card. In another preferred embodiment of the invention, panel 20 is a suitable size for mailing, according to the local postal regulations. In some preferred embodiments of the invention, panel 20 may contain prepaid postage or a prepaid postal mailing number. In the most preferred embodiment of the invention, panel 20 contains preprinted questions to be answered by the person receiving the package. In the best embodiment of the invention known to the inventors, the closed mailing package measures about 3⅝ inches wide, 5¾" long and ⅝" thick.

In a second preferred embodiment of the invention, panel 12 may be the reply card. In such an embodiment, score lines 37 and 39 are perforated to facilitate detachment, but score line 25 is not perforated. In alternate embodiments of the invention, where panel 20 includes the reply card, panel 12 may include a second detachable reply card. Alternatively, panel 12 may include additional information, according to the desired use of the invention. The scope of the present invention is intended to include a blank and box formed from such a blank, where the blank is the mirror image of the blank shown in FIG. 3.

While the present invention has been described and illustrated in conjunction with a number of specific embodiments, those skilled in the art will appreciate that variations and modifications may be made without departing from the principles of the invention as herein illustrated, described and claimed.

The invention may be embodied in other specific forms without departing from the spirit or essential characteristics thereof. The present embodiments are to be considered in all respects as illustrative, and not restrictive. The scope of the invention, is therefore, indicated by the appended claims rather than by the foregoing description, and all changes which come within the meaning and range of equivalency of the claims are to be embraced within their scope.

We claim:

1. A mailable package and reply card, comprising:

a front panel having a first end and a second end;

a first top panel having a first end and a second end, said first end of said first top panel being hingedly connected to said second end of said front panel;

a top panel connecting panel having a first end and a second end, said second end of said front panel being hingedly connected to first end of said top panel connecting panel;

a bottom panel having a first end and a second end and first and second sides, said first end of said bottom panel being hingedly connected to said second end of said top panel connecting panel;

a bottom panel connecting panel having a first end and a second end, said first end of said bottom panel connecting panel being hingedly connected to said second end of bottom panel;

a second top panel having a first end and a second end, said first end of said second top panel being hingedly connected to said second end of said bottom panel connecting panel;

a first side panel having a first side and a second side and a top end, said first side of said first side panel being hingedly connected to said second side of said bottom panel;

a third top panel having first and second sides and first and second ends, said first side of said third top panel being hingedly connected to said second side of said first side panel;

a second side panel having first and second sides and a top end, said first side of said second side panel being hingedly connected to said second side of said third top panel; and an overlapping panel having a first side and a second side, said first side of said overlapping panel being hingedly connected to said second side of said second side panel;

wherein, when said box is closed, said second top panel is disposed between said first and third top panels, and said bottom wall connecting panel is adjacent to said front wall;

wherein said overlapping panel is connected adjacent to said first side of said bottom panel;

wherein said first end of said third top panel, said top ends of said first and second side walls and said first end of said bottom panel form an aperture for receiving informational media; and wherein said reply card is included on a panel selected from the group consisting of first top panel and said second top panel.

2. A package according to claim 1, further comprising:

a closure having a first end and second end, wherein said second end of said closure is hingedly connected to said first end of said front wall; and an insertion slit for receiving said closure, said insertion slit being located in said hinged connection between said bottom panel and said bottom panel connecting panel, said first end of said closure being adapted to be inserted into said insertion slit.

3. A package according to claim 1, further comprising:

an extension panel having a first end and a second end, said first end of said extension panel being hingedly connected to said second end of said third top panel; and a flap panel having a first end and a second end, said first end of said flap panel being hingedly connected to said second end of said extension panel.

4. A package according to claim 1, wherein said box further comprises an informational media.

5. A box according to claim 4, wherein said informational media is selected from the group consisting of audio tapes, video tapes and CD's.

6. A blank for forming a mailable package including a reply card comprising:

a front panel having a first end and a second end;

a first top panel having a first end and a second end, said first end of said first top panel being hingedly connected to said second end of said front panel;

a top panel connecting panel having a first end and a second end, said second end of said front panel being hingedly connected to first end of said top panel connecting panel;

a bottom panel having a first end and a second end and first and second sides, said first end of said bottom panel being hingedly connected to said second end of said top panel connecting panel;

a bottom panel connecting panel having a first end and a second end, said first end of said bottom panel connecting panel being hingedly connected to said second end of bottom panel;

a second top panel having a first end and a second end, said first end of said second top panel being hingedly connected to said second end of said bottom panel connecting panel;

a first side panel having a first side and a second side and a top end, said first side of said first side panel being hingedly connected to said second side of said bottom panel;

a third top panel having first and second sides and first and second ends, said first side of said third top panel being hingedly connected to said second side of said first side panel;

a second side panel having first and second sides and a top end, said first side of said second side panel being hingedly connected to said second side of said third top panel; and an overlapping panel having a first side and a second side, said first side of said overlapping panel being hingedly connected to said second side of said second side panel;

wherein said overlapping panel is adapted to be connected adjacent to said first side of said bottom panel; and wherein said reply card is included on a panel selected from the group consisting of said first top panel and said second top panel.

7. A blank according to claim 6, further comprising:

an extension panel having a first end and a second end, said first end of said extension panel being hingedly connected to said second end of said third top panel; and a flap panel having a first end and a second end, said first end of said flap panel being hingedly connected to said second end of said extension panel.

8. A blank according to claim 6, further comprising:

a closure having a first end and second end, wherein said second end of said closure is hingedly connected to said first end of said front wall; and an insertion slit for receiving said closure, said insertion slit being located in said hinged connection between said bottom panel and said bottom panel connecting panel, said first end of said closure being adapted to be inserted into said insertion slit.

9. A mailable package including a reply card, comprising:

a front wall (10), a top panel (12), a back panel (14), a bottom panel (16), inside front panel (18), intermediate top panel (20), first side panel (17*a*), inside top panel (17), second side panel (17*b*), and gluing panel (17*c*)

wherein said front wall (10) is hingedly connected to said top panel (12);

said top panel (12) is hingedly connected to said back panel (14);

said back panel (14) is hingedly connected to said bottom panel (16);

said bottom panel (16) is hingedly connected to said inside front panel (18);

said intermediate top panel (20) is hingedly and releasably connected to said inside front panel (18);

said bottom panel (16) is hingedly connected to first side panel (17*a*);

said first side panel (17*a*) is hingedly connected to inside top panel (17);

said inside top panel (17) is hingedly connected to second side panel (17*b*);

said second side panel (17*b*) is hingedly connected to said gluing panel (17*c*); and said gluing panel (17*c*) is hingedly attached to said bottom panel (16).

10. A blank for forming a mailable package including a reply card, comprising:

a front wall (10), a top panel (12), a back panel (14), a bottom panel (16), inside front panel (18), intermediate top panel (20), first side panel (17*a*), inside top panel (17), second side panel (17*b*), and gluing panel (17*c*);

wherein said front wall (10) is hingedly connected to said top panel (12);

said top panel (12) is hingedly connected to said back panel (14);

said back panel (14) is hingedly connected to said bottom panel (16);

said bottom panel (16) is hingedly connected to said inside front panel (18);

said intermediate top panel (20) is hingedly and releasably connected to said inside front panel (18);

said bottom panel (16) is hingedly connected to first side panel (17*a*);

said first side panel (17*a*) is hingedly connected to inside top panel (17);

said inside top panel (17) is hingedly connected to second side panel (17*b*); and said second side panel (17*b*) is hingedly connected to said gluing panel (17*c*).

11. A method of using a mailable package and reply card, comprising:

A) inserting informational media into a box, and

B) mailing said box to a recipient;

wherein said box comprises:

a front panel having a first end and a second end;

a first top panel having a first end and a second end, said first end of said first top panel being hingedly connected to said second end of said front panel;

a top panel connecting panel having a first end and a second end, said second end of said front panel being hingedly connected to first end of said top panel connecting panel;

a bottom panel having a first end and a second end and first and second sides, said first end of said bottom panel being hingedly connected to said second end of said top panel connecting panel;

a bottom panel connecting panel having a first end and a second end, said first end of said bottom panel connecting panel being hingedly connected to said second end of bottom panel;

a second top panel having a first end and a second end, said first end of said second top panel being hingedly connected to said second end of said bottom panel connecting panel;

a first side panel having a first side and a second side and a top end, said first side of said first side panel being hingedly connected to said second side of said bottom panel;

a third top panel having first and second sides and first and second ends, said first side of said third top panel being hingedly connected to said second side of said first side panel;

a second side panel having first and second sides and a top end, said first side of said second side panel being hingedly connected to said second side of said third top panel; and an overlapping panel having a first side and a second side, said first side of said overlapping panel being hingedly connected to said second side of said second side panel;

wherein, when said box is closed, said second top panel is disposed between said first and third top panels, and said bottom wall connecting panel is adjacent to said front wall;

wherein said overlapping panel is connected adjacent to said first side of said bottom panel;

wherein said first end of said third top panel, said top ends of said first and second side walls and said first end of said bottom panel form an aperture for receiving informational media; and wherein said reply card is included on a panel selected from the group consisting of first top panel and said second top panel.

12. A method according to claim 11, wherein said informational media is selected from the group consisting of video tape, audio tape and a CD.

* * * * *